US005850614A

United States Patent [19]

Crichlow

[11] Patent Number: 5,850,614

[45] Date of Patent: Dec. 15, 1998

[54] METHOD OF DISPOSING OF NUCLEAR WASTE IN UNDERGROUND ROCK FORMATIONS

[76] Inventor: Henry B. Crichlow, 330 W. Gray St. Suite 504, Norman, Okla. 73069

[21] Appl. No.: 892,250

[22] Filed: Jul. 14, 1997

[51] Int. Cl.[6] ..... G21F 9/00

[52] U.S. Cl. ..... 588/17; 405/128

[58] Field of Search ..... 588/17, 250; 405/128

[56] References Cited

U.S. PATENT DOCUMENTS

| | | | |
|---|---|---|---|
| 3,108,439 | 10/1963 | Reynolds et al. . | |
| 4,500,227 | 2/1985 | Courtois et al. | 405/128 |
| 4,586,849 | 5/1986 | Hastings | 405/128 |
| 5,133,624 | 7/1992 | Cahill | 405/128 |
| 5,338,493 | 8/1994 | Welch | 588/16 |
| 5,489,740 | 2/1996 | Fletcher | 588/250 |

*Primary Examiner*—Ngoclan Mai
*Attorney, Agent, or Firm*—Michael I. Kroll

[57] ABSTRACT

A method of disposing nuclear waste in underground rock formations (18). The method includes the steps of selecting an area of land having a rock formation (18) positioned therebelow, the rock formation (18) must be of a depth able to prevent radioactive material placed therein from reaching the surface and must be at least a predetermined distance from active water sources and drilling a vertical wellbore (14) from the surface which extends into the underground rock formation (18). A primary horizontal lateral (20) is drilled from the vertical wellbore (14) whereby the surface of the primary horizontal lateral (20) is defined by the underground rock formation (18). A first layer of cement (30) is placed within the primary horizontal lateral (20) and a second layer of steel (32) is secured within the first layer of cement (30). Nuclear waste to be stored within the lateral is placed in a canister (38) and the encapsulated nuclear waste is positioned within the primary horizontal lateral (20). The primary horizontal lateral (20) is then filled with cement (48) to seal the encapsulated nuclear waste therein. Additional primary horizontal laterals (20) may be drilled from the vertical wellbore (14) and then secondary and tertiary horizontal laterals (24, 26) can be drilled from the primary horizontal lateral (20). Additional layers of lead, cement and steel may be used to cover the laterals and shield the rock formation (18) from any radiation leakage. Furthermore, front and end plugs (49, 50) may be positioned at either end of the laterals, retaining the canisters (38) therein and providing added protection from leakage of any solid, liquid or gaseous material.

20 Claims, 11 Drawing Sheets

METHOD OF DISPOSING OF NUCLEAR WASTE IN UNDERGROUND ROCK FORMATIONS

BACKGROUND OF THE INVENTION

1. Field of the Invention

The instant invention relates generally to a method of disposing of nuclear waste and, more specifically, to disposing of nuclear waste in underground rock formations using multilateral boreholes.

2. Description of the Prior Art

Numerous methods for disposing of nuclear waste have been provided in the prior art. For example, an existing disposal method for nuclear waste is to bury the waste in shallow vaults also known as deep vertical wells. This method places the waste in vertical silos drilled into a mountain by a tunnel boring machine. The storage chambers are to be drilled approximately 1,000 feet into the mountain and can cost billions of dollars.

Another method proposed for disposing of nuclear waste is burial of the waste in suitable canisters in mud in the bottom of the ocean. This method is dangerous as the canisters may rupture and pollute the ocean, killing life found in the surrounding area.

A further proposal for disposing of nuclear waste is to place the waste into specially designed modules and launch the modules into space using the space shuttle. The modules will then be propelled into the sun for final incineration. This system would cost many billions of dollars and thus is not very practical.

It has also been proposed to bury the waste in near surface trenches or wells as used in landfills. This approach is not viable due to the great danger associated with disposing of the waste so close to the surface where leakage of the waste may do great harm to all life in the surrounding area.

It has further been proposed to bury the waste in deep vertical wells which will be sealed with cement or mud.

Burying the waste in the polar ice caps whereby the great masses of ice could enclose and isolate the radioactive material has also been proposed.

The above described methods are all illustrative of prior art methods of nuclear waste disposal. While these methods may be suitable for the particular purpose to which they address, they would not be as suitable for the purposes of the present invention as heretofore described.

BRIEF SUMMARY OF THE INVENTION

The present invention is concerned with disposing of nuclear waste and, more specifically, to a method of disposing of nuclear waste in underground rock formations using multilateral horizontal boreholes.

A primary object of the present invention is to provide a method of disposing of nuclear waste in underground rock formations.

Another object of the present invention is to provide a method of disposing of nuclear waste in underground rock formations which will provide prolonged safety from the nuclear waste and added protection to human health and the environment.

An additional object of the present invention is to provide a method of disposing of nuclear waste in underground rock formations which will provide protection in case of rupturing or leaking of the canister in which the waste is stored.

Another object of the present invention is to provide a method of disposing of nuclear waste in underground rock formations which will provide safe storage of the waste for at least 10,000 years.

A further object of the present invention is to provide a method of disposing of nuclear waste in underground rock formations which is impervious to surface effects such as flooding, glaciation or seismic interference.

A still further object of the present invention is to provide a method of disposing of nuclear waste in underground rock formations which will bury the waste in horizontally extending boreholes positioned well below the earth's surface.

An even further object of the present invention is to provide a method of disposing of nuclear waste in underground rock formations which will drill a primary vertical wellbore and secondary horizontal laterals extending therefrom.

A yet further object of the present invention is to provide a method of disposing of nuclear waste in underground rock formations wherein the secondary laterals will include an inner lining made from layers of steel and lead.

A still further object of the present invention is to provide a method of disposing of nuclear waste in underground rock formations wherein front and end plugs will be placed within the secondary laterals for retaining canisters filled with waste.

A method of disposing nuclear waste in underground rock formations is disclosed by the present invention. The method includes the steps of selecting an area of land having a rock formation positioned therebelow, the rock formation must be of a depth able to prevent radioactive material placed therein from reaching the surface and must be at least a predetermined distance from active water sources and drilling a vertical wellbore from the surface of the selected area which extends into the underground rock formation. A primary horizontal lateral is drilled from the vertical wellbore whereby the surface of the horizontal lateral is defined by the underground rock formation. A steel casing is placed within the horizontal lateral and cemented in place by circulating cement in the annular space between the steel casing and the wall of the wellbore. Nuclear waste to be stored within the lateral is placed in a canister and the encapsulated nuclear waste is positioned within the primary horizontal lateral. The primary horizontal lateral is then filled with cement to seal the encapsulated nuclear waste therein. Additional primary horizontal laterals can be drilled from the vertical wellbore and secondary and tertiary horizontal laterals can be drilled from the primary horizontal lateral. Additional layers of lead, cement and steel may be used to cover the laterals and shield the rock formation from any radiation leakage. Furthermore, front and end plugs may be positioned at either end of the laterals, retaining the canisters therein and providing added protection from leakage of any solid, liquid or gaseous material.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
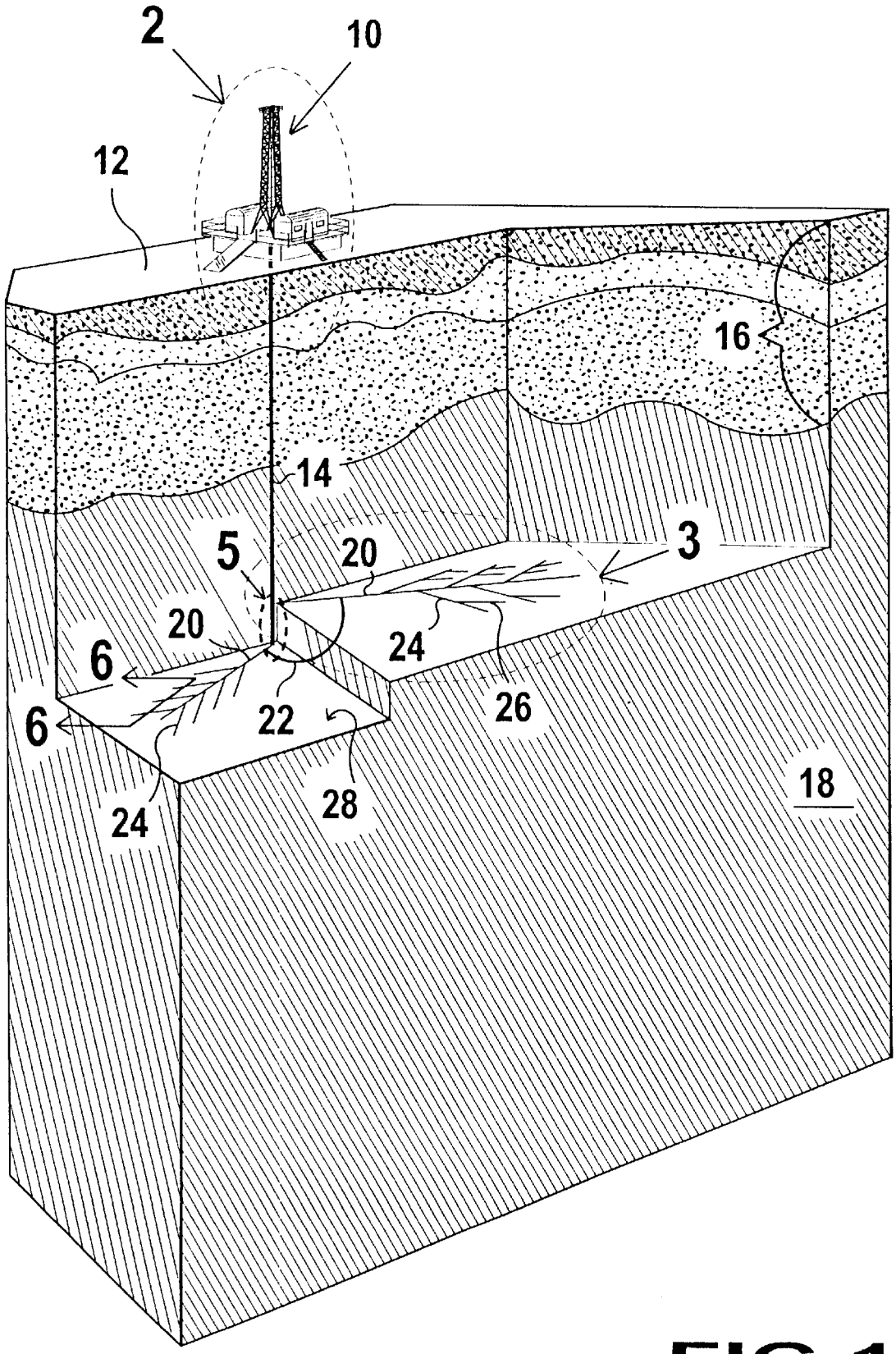
FIG. 1 is a perspective cross-sectional view of a section of earth on which the method of disposing of nuclear waste in underground rock formations of the present invention is practiced.
Figure 2:
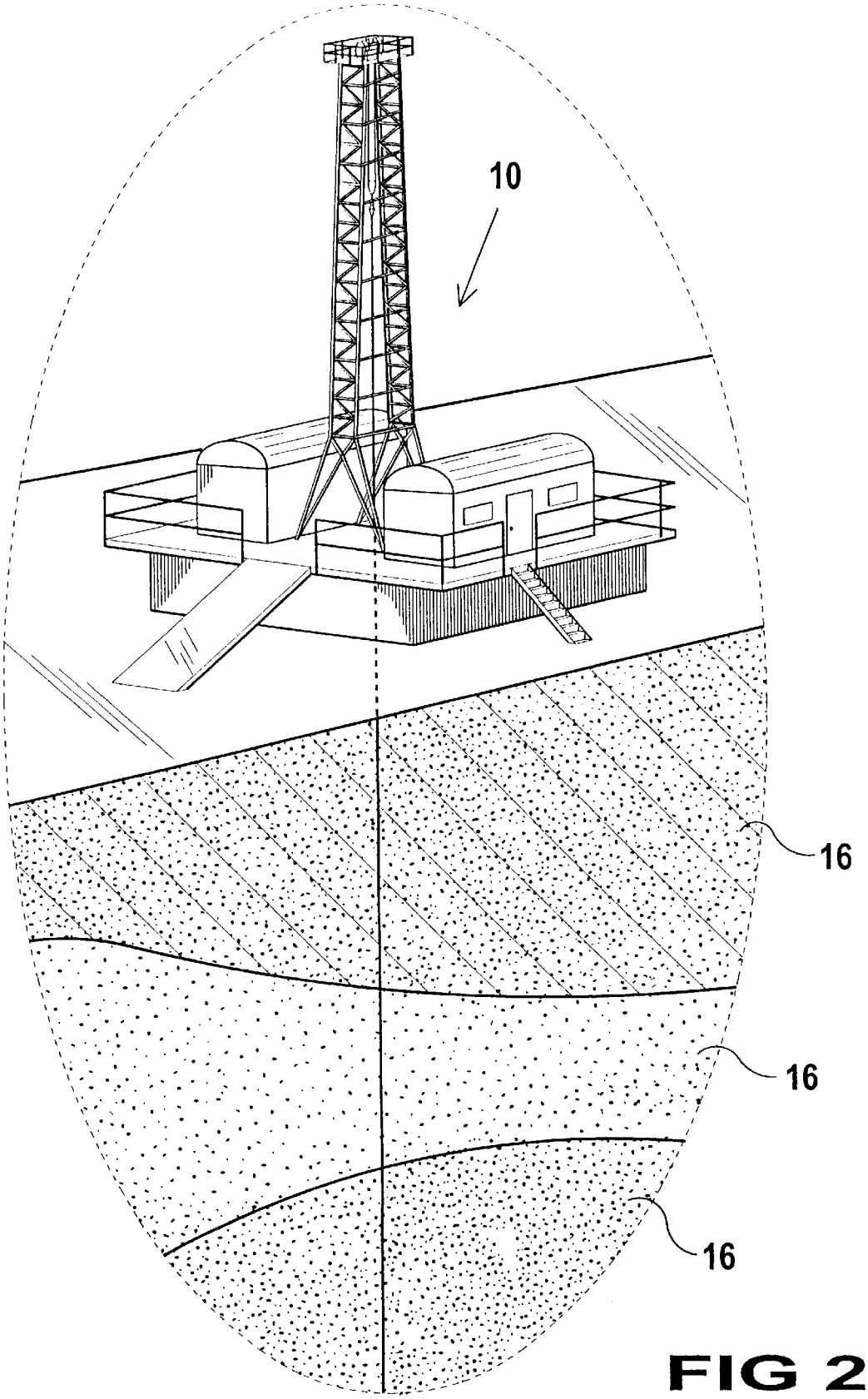
FIG. 2 is a perspective view of drilling equipment used to perform the method of disposing of nuclear waste in underground rock formations of the present invention.

Turning now descriptively to the drawings, in which similar reference characters denote similar elements throughout the several views, the Figures illustrate a method of disposing of nuclear waste in underground rock formations of the present invention. With regard to the reference numerals used, the following numbering is used throughout the various drawing figures.

| | |
|---|---|
| 10 | drilling rig |
| 12 | earth's surface |
| 14 | vertical wellbore |
| 16 | surface layers |
| 18 | cap rock layer |
| 20 | primary lateral |
| 22 | angle between primary laterals |
| 24 | secondary laterals |
| 26 | tertiary laterals |
| 28 | horizontal plane |
| 30 | first outer casing (cement) |

-continued

| | |
|---|---|
| 32 | second outer casing (steel) |
| 34 | first inner casing (cement) |
| 36 | second inner casing (lead) |
| 38 | canister |
| 40 | centralizers |
| 42 | far end of lateral |
| 44 | front end of lateral |
| 46 | windows |
| 48 | cement filler |
| 49 | front plug |
| 50 | end plug |
| 52 | inner lead lining |
| 54 | outer steel casing |
| 56 | liner hangers |
| 58 | sandwiched layer of lead |
| 60 | first layer of steel |
| 62 | second layer of steel |
| 64 | third layer of steel |
| 66 | lead casing |
| 68 | steel casing |
| 70 | connector |
| 72 | tubular string |

DETAILED DESCRIPTION OF THE PREFERRED EMBODIMENT

A preferred embodiment of the method of disposing of nuclear waste in underground rock formations in accordance with the present invention will now be described with reference to FIGS. 1–6 in which the present invention is illustrated.

Specifically, FIG. 1 shows a preferred embodiment of the equipment used and the results obtained when performing the method of the present invention. A drilling rig illustrated generally by the numeral 10 is positioned on an isolated surface 12 and is used to create a vertical wellbore 14 which will extend vertically into the earth's surface. The vertical wellbore 14 extends through a plurality of layers of the earth's surface 16 and into a layer of cap rock 18. The layer of cap rock 18 is a specially selected rock formation deep enough below the earth's surface to prevent radiation which may leak from reaching the surface. The selected rock formations have existed for billions of years as is evidenced by the chronological fossil history found in the rock strata.

Branching off and extending horizontally from the vertical wellbore 14 at a depth below the earth's surface occupied by the layer of cap rock 18 are primary laterals 20. The primary laterals 20 may be at different depths or at the same depth and extending at an angle 22 from one another. Any number of primary laterals 20 may be drilled from the vertical wellbore, two primary laterals are shown in FIG. 1 for purposes of example only. Extending from the primary laterals 20 and along the same horizontal plane 28 are secondary laterals 24 and extending from the secondary laterals 24 and also along the same horizontal plane 28 are tertiary laterals 26. The primary, secondary and tertiary laterals 20, 24, and 26 respectively of a single branch extending from the vertical wellbore 14 all extend in the same horizontal plane 28 while each branch may extend in different horizontal planes as shown in FIG. 1. The formation of cap rock 18 should enclose the primary, secondary and tertiary laterals 20, 24 and 26 on all surfaces to thereby define the dimensions of the laterals and ensure isolation for an indefinite period.

The drilling rig 10 is well known and similar to those used in oil drilling and exploration to reach oil deposits located deep beneath the earth's surface. The drilling rig 10 is illustrated in more detail in FIG. 2.

While a preferred structure for the drilling rig 10 is shown and described herein, those of ordinary skill in the art who have read this description will appreciate that there are numerous other structures for the drilling rig 10 and, therefore, should be construed as including all such structures as long as they achieve the desired result of creating a primary wellbore extending a predetermined distance below a surface of the earth, and therefore, that all such alternative mechanisms are to be considered as equivalent to the one described herein.

Figure 3:
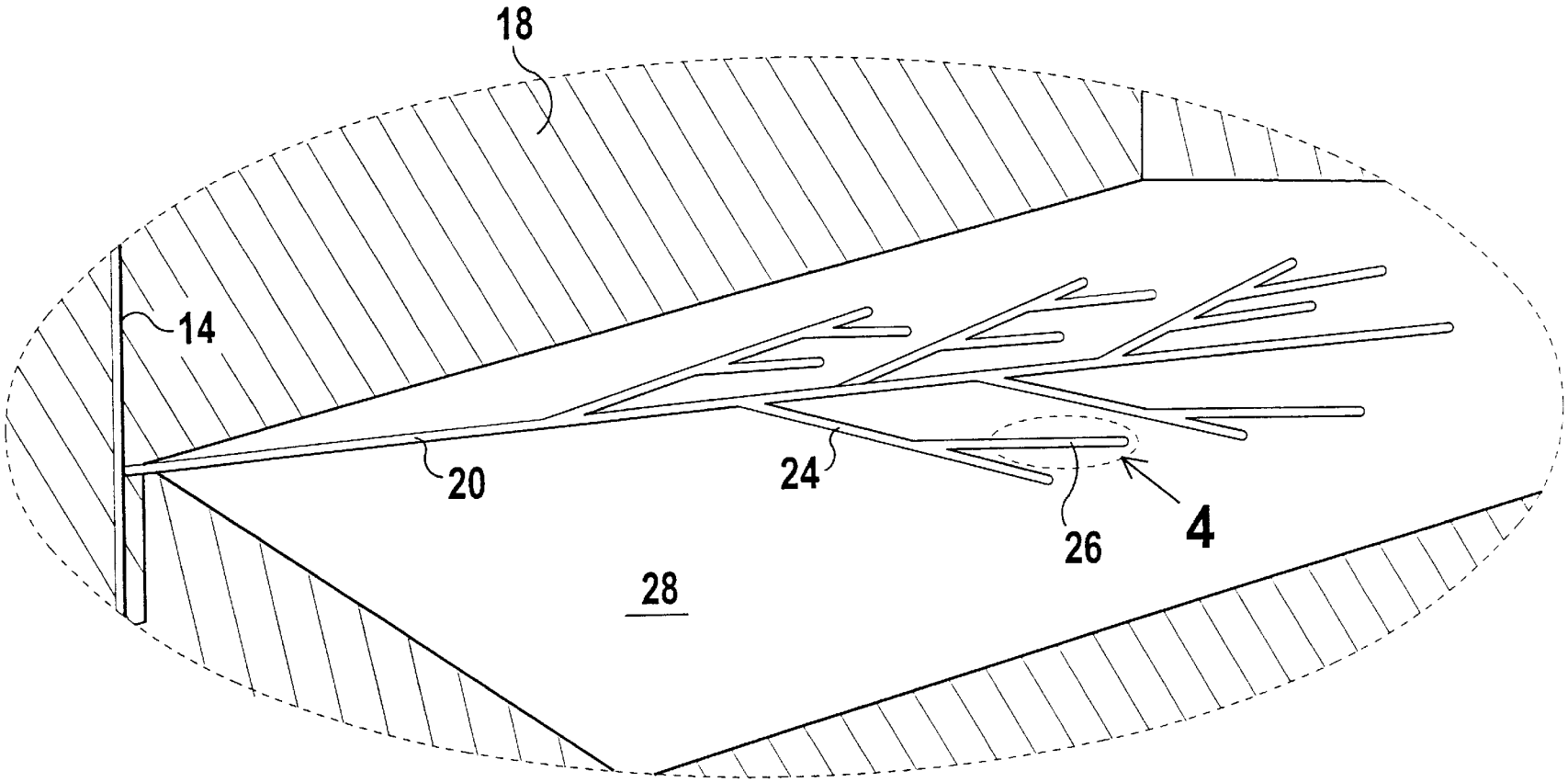
FIG. 3 is a perspective view of horizontal boreholes drilled in accordance with the method of disposing of nuclear waste in underground rock formations of the present invention within the circle labeled 3 in FIG. 1.

A single branch extending from the vertical wellbore 14 is illustrated in FIG. 3. Extending vertically through the cap rock 18 is the vertical wellbore 14. A primary lateral 20 branches out horizontally from the vertical wellbore 14 along the horizontal plane 28 and a plurality of secondary laterals 24 extend from the primary lateral 20 in the horizontal plane 28. A plurality of tertiary laterals 26 extend from the secondary laterals 24 and in the horizontal plane 28. Any number of secondary laterals 24 can extend from each primary lateral 20 and any number of tertiary laterals 26 can extend from each secondary lateral 24. The amount of secondary and tertiary laterals 24, 26 are for purposes of description only and not meant to be limiting. The only requirement on the positioning of the secondary and tertiary laterals 24 and 26 is that they cannot overlap one another. Overlapping of the laterals causes communication therebetween and will act to reduce the effectiveness of the structure.

Figure 4:
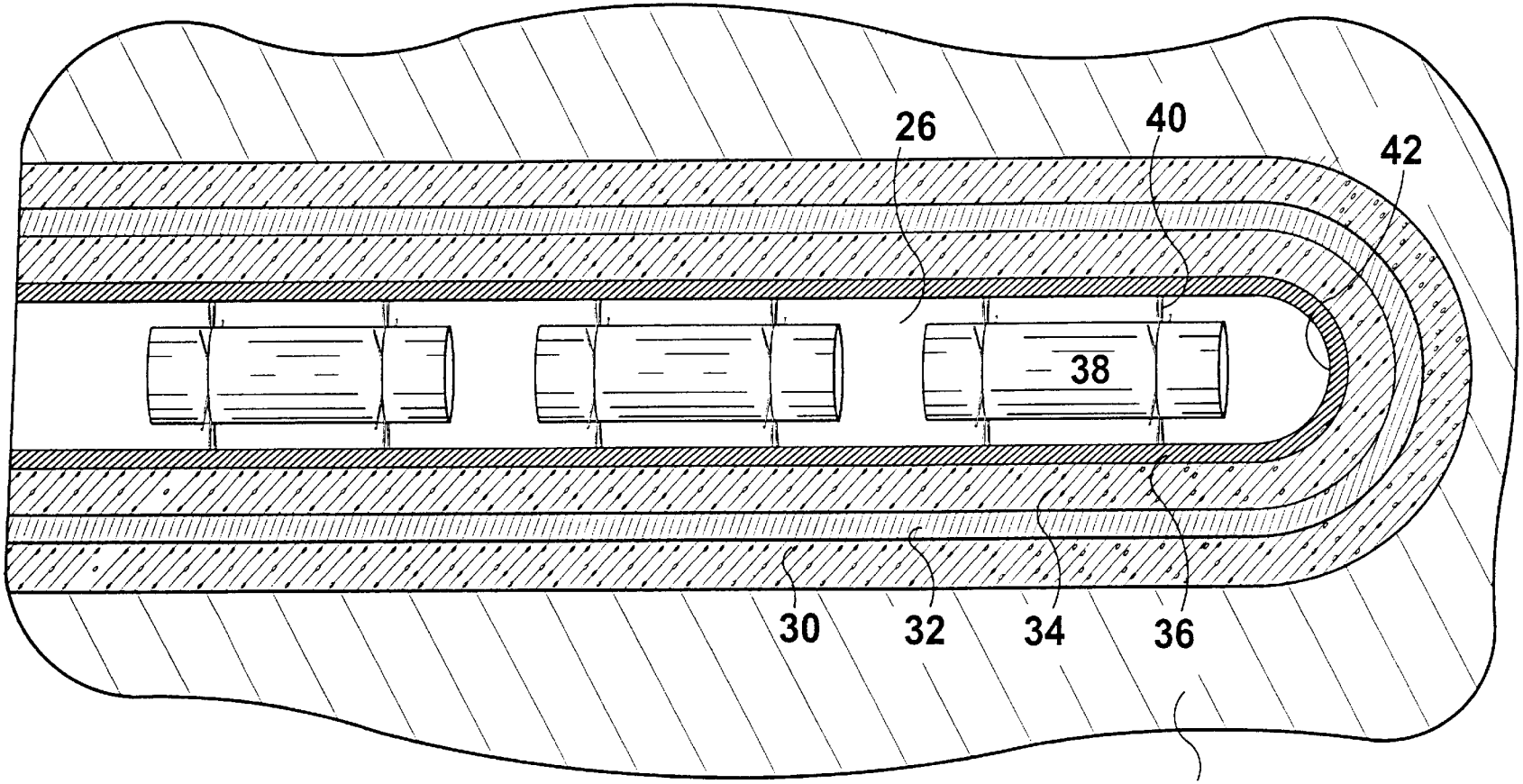
FIG. 4 is a partial cross-sectional view of a section of earth containing canisters storing nuclear waste in accordance with the method of disposing of nuclear waste in underground rock formations of the present invention within the circle labeled 4 in FIG. 3.

FIG. 4 illustrates a preferred construction of the tertiary lateral 26 within the circle labeled 4 of FIG. 3 in greater detail, the construction of the primary and secondary laterals 20, 24, respectively, are identical thereto. The tertiarylateral 26 is comprised of a plurality of layers. A first outer casing 30 of cement within the lateral 26 forms the first outer layer. A second outer casing 32 is made of steel and is sealed within the first outer casing 30. Within the second outer casing 32 is a first inner cement casing 34 and a second inner casing 36 made of lead is positioned within the first inner casing 34.

Nuclear waste is placed and secured within a radioactive capsule or canister 38. The radioactive canister 38 is well known in the art and presently used for securing nuclear waste. Any known method for securing nuclear waste in a container or capsule for placement in a lateral as produced by the present method may be used and does not form part of the inventive concept. It is thus not deemed necessary to further describe the process of securing the nuclear waste within the capsule. The capsule 38 is positioned within the second inner layer 36 of the lateral 26 and may be held in a steady position within the lateral by a plurality of centralizers 40. The sequence of layers coating the lateral 26 act to protect the rock formation 18 in which the lateral 26 extends from leakage of any nuclear waste.

Figure 6:
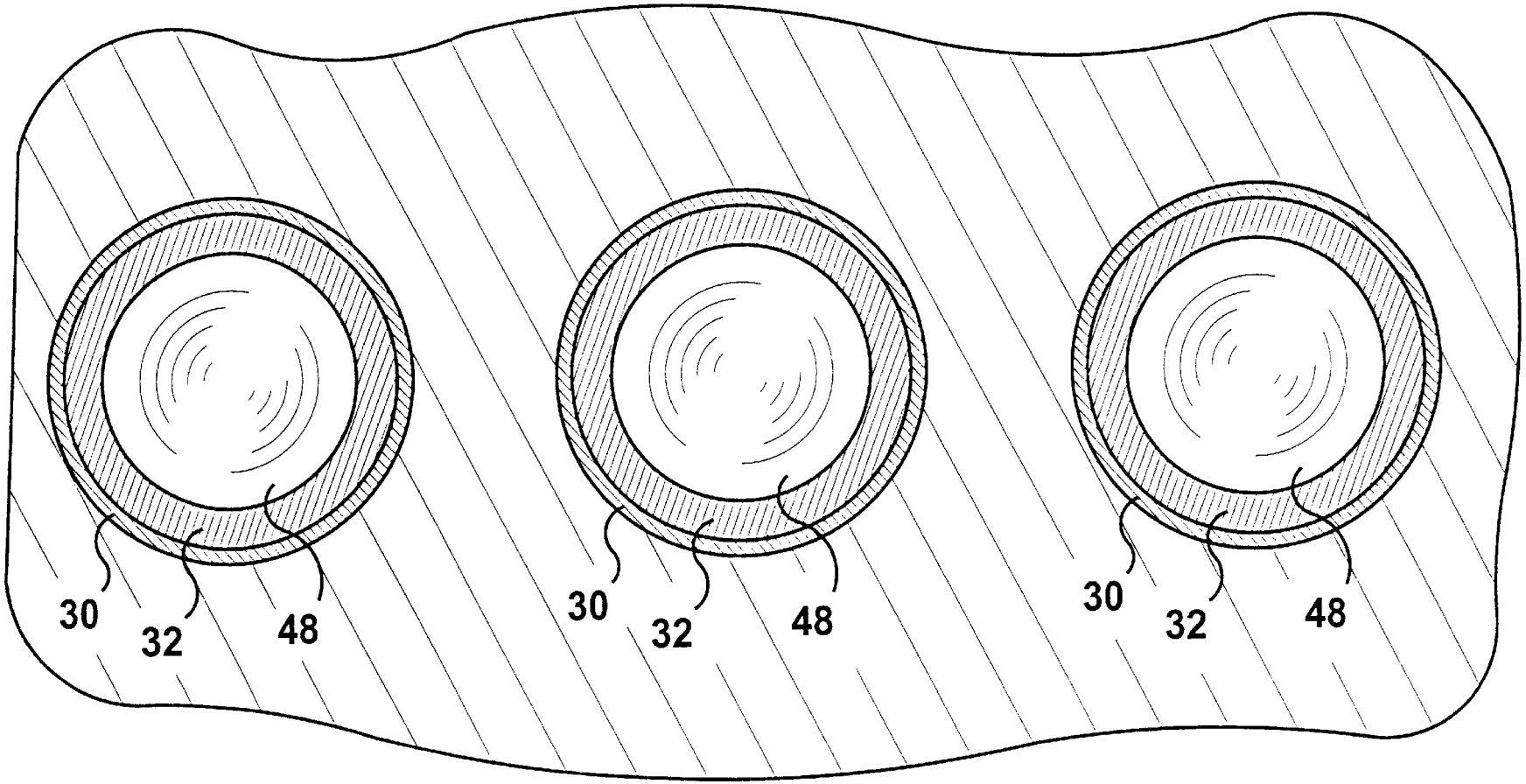
FIG. 6 is a cross-sectional view taken along the line 6—6 of FIG. 1.

Once the canisters 38 are positioned within the lateral 26 they may be secured therein by filling the lateral with cement 48 as is illustrated in FIG. 6 showing a cross-sectional view through a plurality of tertiary laterals 26 taken along the line 6—6 of FIG. 1.

Figure 5:
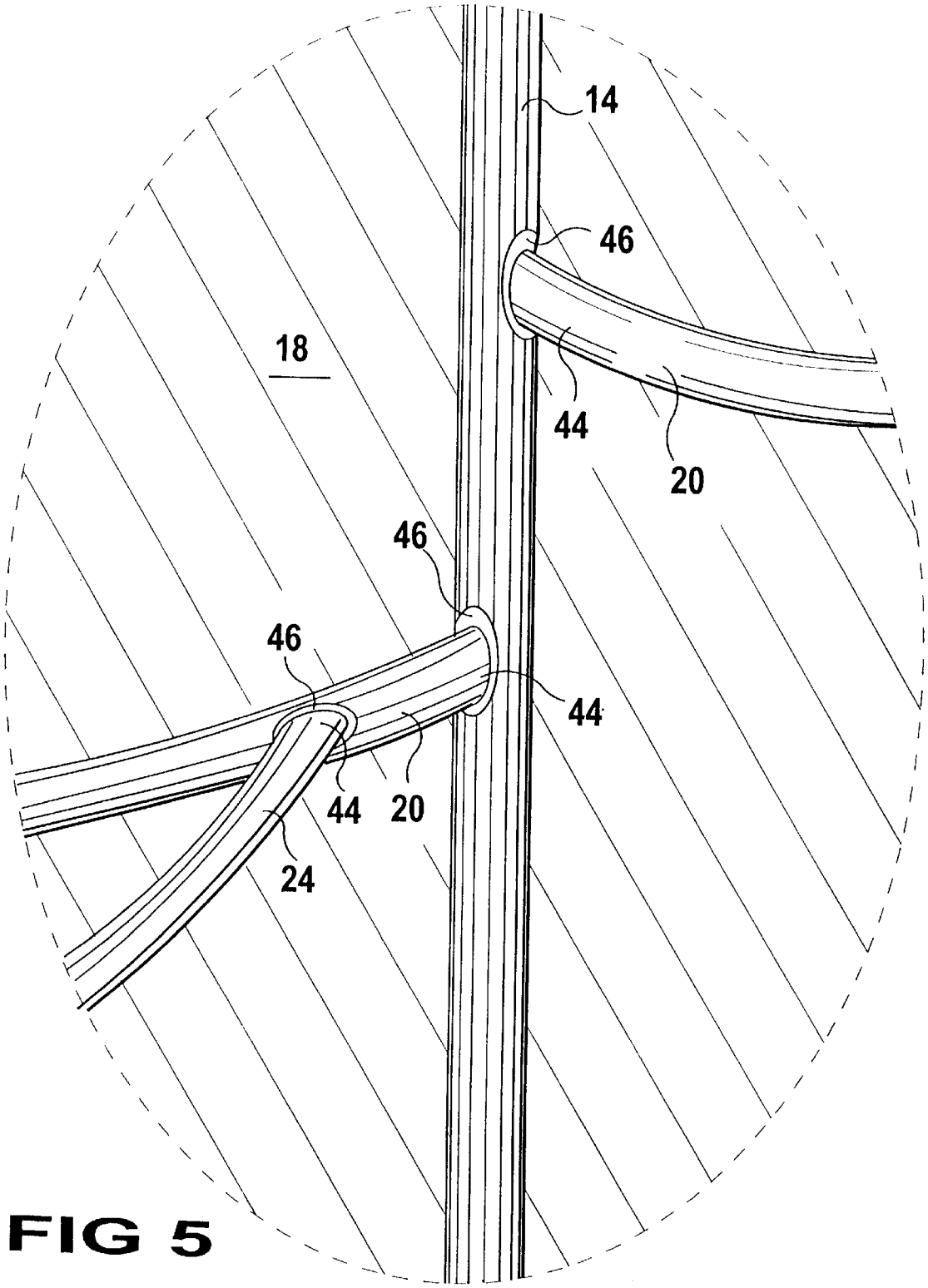
FIG. 5 is a perspective view of the laterals within the circle labeled 5 in FIG. 1.

FIG. 5 illustrates a partial view of a nuclear waste storage network including a wellbore 14 and primary and secondary laterals 20, 24, respectively, extending therefrom. In order to produce a primary lateral 20, a window 46 must be cut into the vertical wellbore 14 at the point from which the primary lateral 20 is to extend. The primary lateral 20 is then drilled through the window 46 and extending horizontally into the rock formation 18. The technology for cutting windows and drilling horizontally through these windows is well known in the industry and does not form part of this inventive concept The same is true for producing the secondary and tertiary laterals 24, 26 a window 46 must be cut into the lateral at the point from which the dependent lateral will extend. The dependent lateral will then be drilled through the window 46 and into the rock formation 18 in the identical horizontal plane in which the primary lateral lies.

Figure 7:
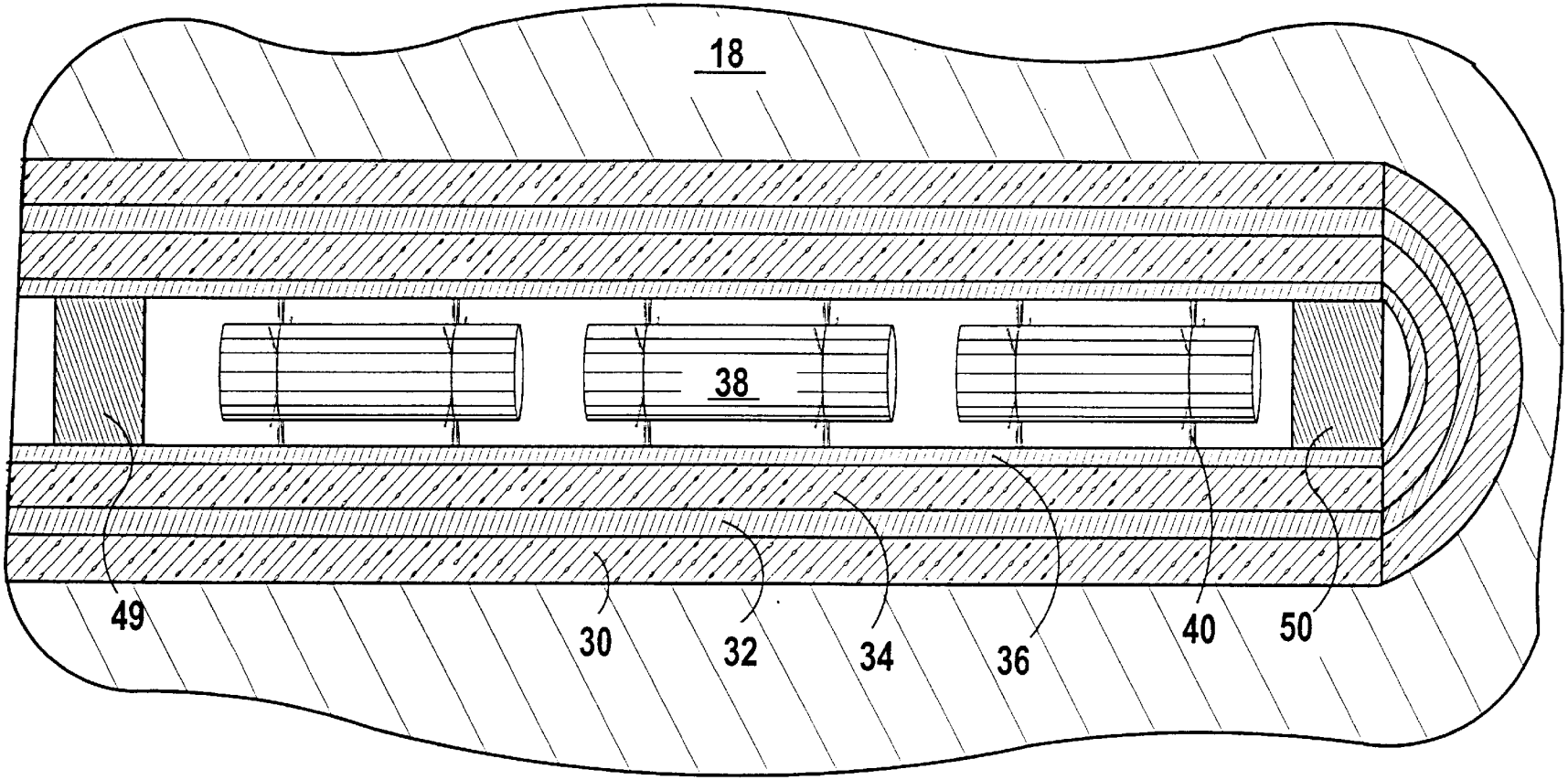
FIG. 7 is a cross-sectional view of a lateral used to store the canisters including front and end plugs.

In order to provide additional protection from leaking nuclear waste, a front plug 49 and an end plug 50 may be positioned within the lateral as is illustrated in FIG. 7. The front plug 49 is positioned adjacent the window 46 at the point at which the lateral branches and the end plug 50 is positioned at an end 42 of the lateral opposite the front plug 49. The end plug 50 is inserted into the lateral prior to placement of the canisters 38 and the front plug 49 is inserted after the canisters 38 are positioned within the lateral acting to close the lateral to the top of the well or vertical wellbore 14. The front and end plugs 49, 50 close both ends of the lateral thereby isolating the lateral from the top of the well and preventing entry into and exit from the lateral of any liquid, solid or gaseous material thereby providing additional safety from leakage of nuclear waste into the host rock formation 18. These plugs 49, 50 are known and preferably similar to oil field "packers" used to cover the vertical wellbores and prevent oil from exiting the well. However, these plugs 49, 50 may be in any other form which achieves the necessary purpose of providing additional protection from leakage of nuclear waste from the lateral.

Figure 8:
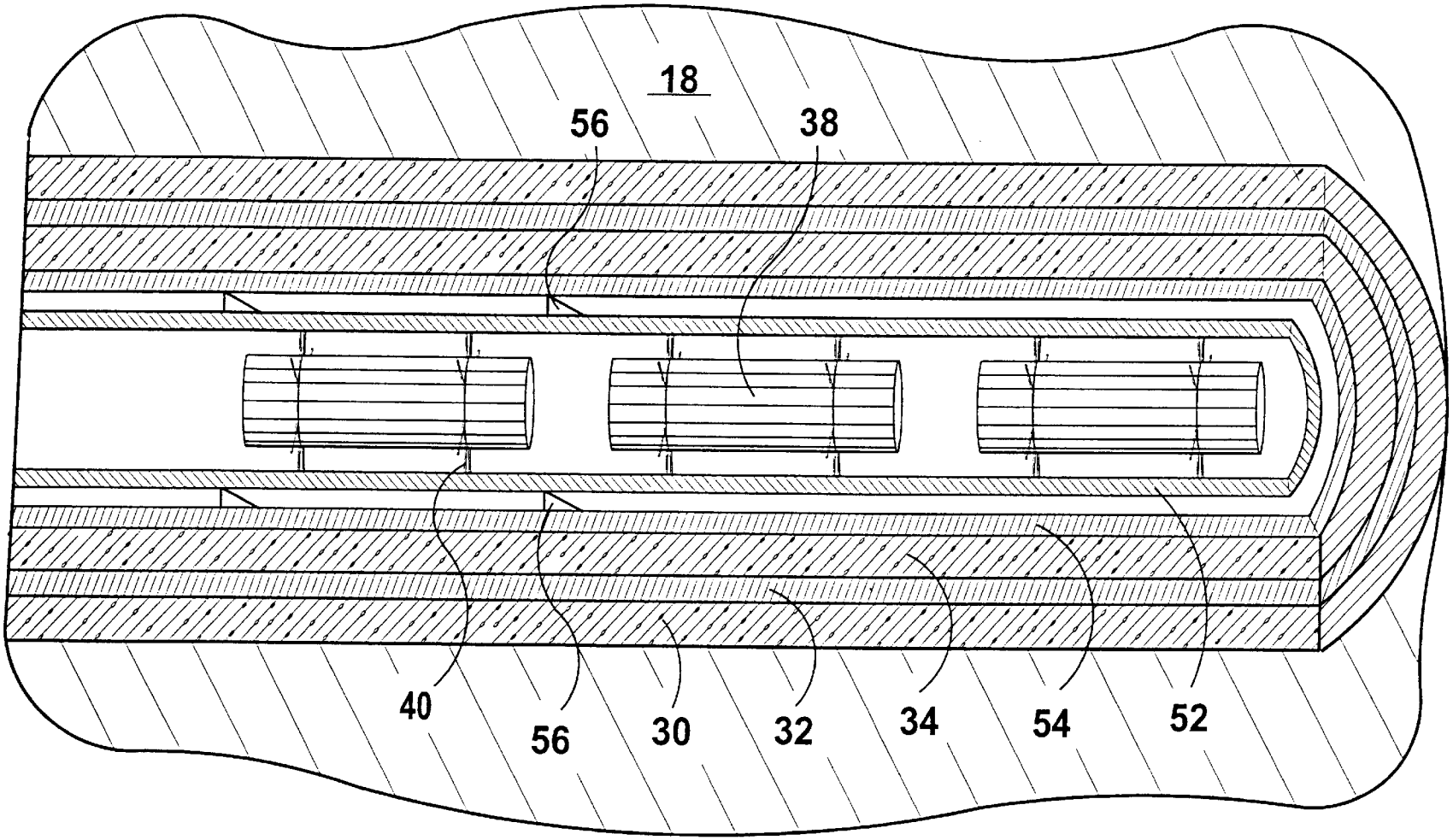
FIG. 8 is a partial cross-sectional view of a second embodiment of the sealing layers within a lateral used to store the canisters.

Other embodiments for the protective layers of the laterals are also possible. One such embodiment is illustrated in FIG. 8 and describes a layered formation which acts to replace the second inner casing 36 made of lead with a three tiered structure. The three tiered structure includes an inner lead lining 52 and an outer steel casing 54 separated by one of liner supports and liner hangers 56. This hanging liner shield acts as a radiation shield. The hanging lead liner 52 extends only to the entry point of the lateral, i.e. the position at which the window 46 is cut, while the support steel layer 54 extends all the way to the top of the vertical wellbore 14.

Figure 9:
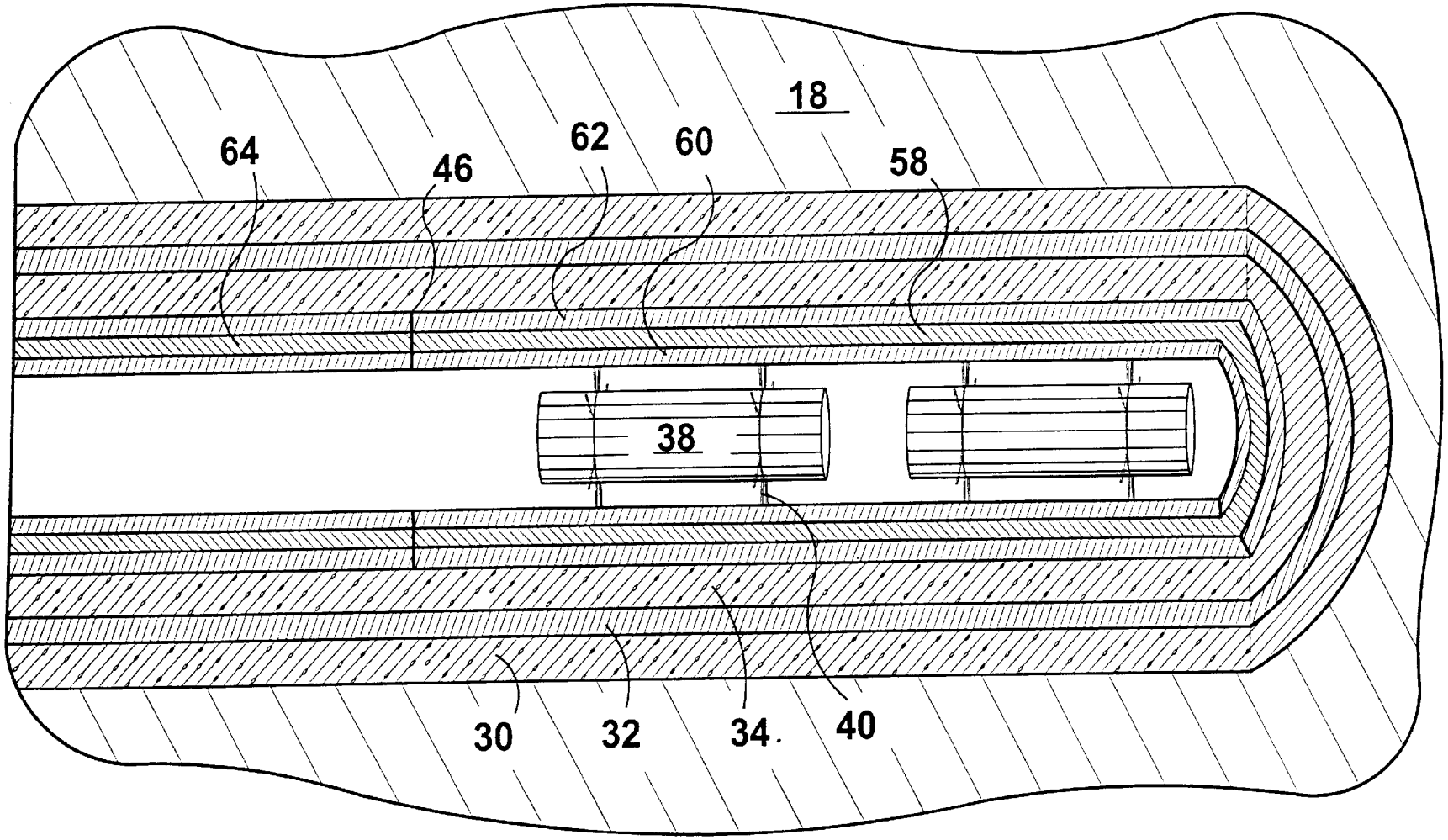
FIG. 9 is a partial cross-sectional view of a third embodiment of the sealing layers within a lateral used to store the canisters.

FIG. 9 illustrates another embodiment which would replace the second inner casing 36 made of lead with a three tiered layer. The three tiered layer includes a layer of lead 58 sandwiched between layers of steel 60, 62. As in the embodiment illustrated in FIG. 8, the lead layer 58 only extends to the entry point of the lateral. A third layer of steel 64 extends between the sandwiching layers of steel 60, 62 from the entry point of the lateral to the top of the vertical wellbore 14. These additional layers 58, 60, 62 and 64 also provide added protection from radiation which may leak from the canisters, preventing the radiation from leaving the lateral and entering the host rock formation 18.

Figure 10:
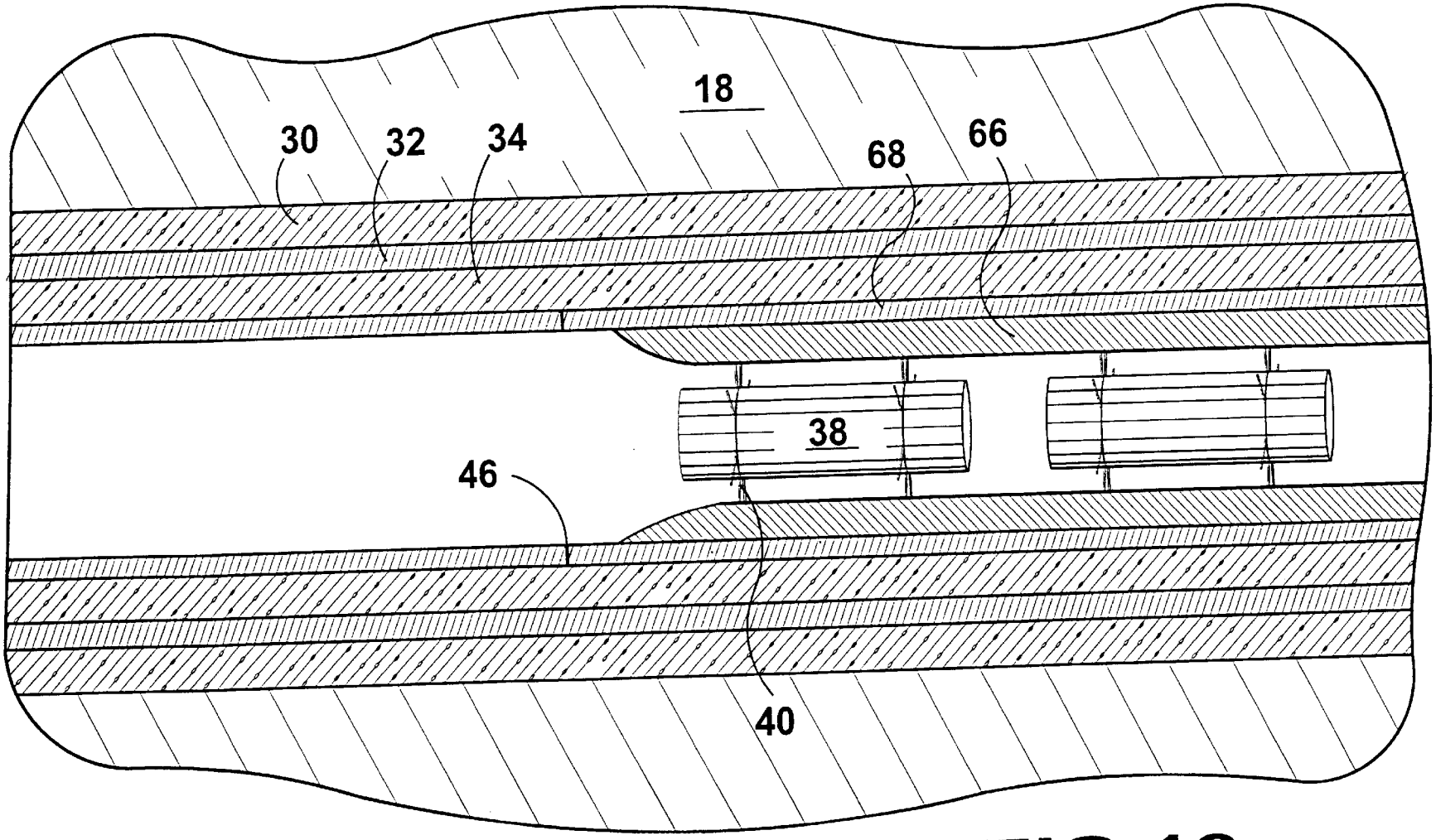
FIG. 10 is a partial cross-sectional view of a fourth embodiment of the sealing layers within a lateral used to store the canisters.

A yet further embodiment for the second inner casing 36 is illustrated in FIG. 10 an includes a lead shield casing 66 surrounded by a steel casing 68. The lead casing 66 is bonded to the steel casing 68 and extends to the entry point of the lateral. The steel casing 68 extends through the lateral and to the top of the vertical wellbore 14. This embodiment, like the embodiments illustrated in FIGS. 4, 8 and 9, provides additional protection for the host rock formation 18 from radiation leakage.

Figure 11:
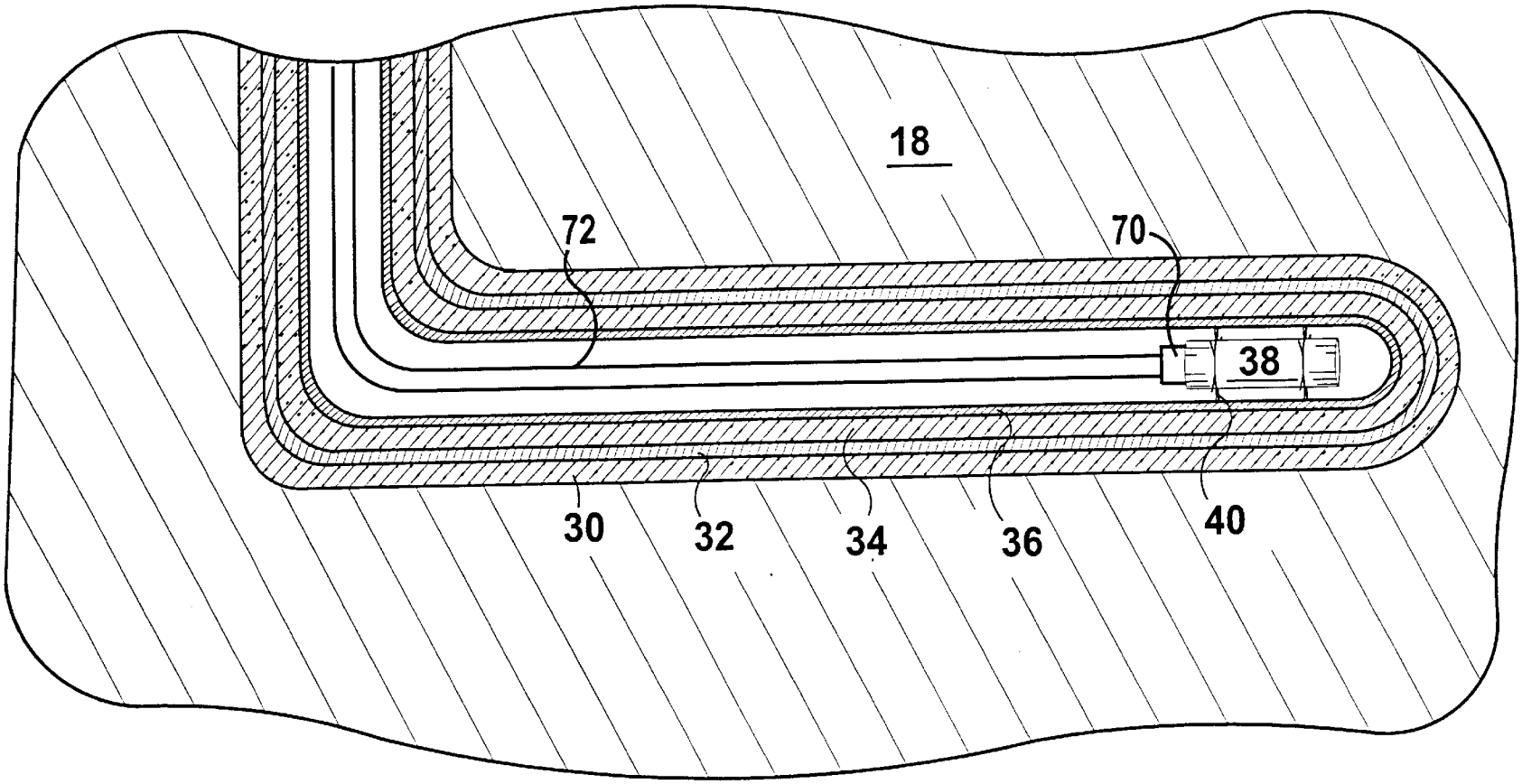
FIG. 11 is a partial cross-sectional view of a lateral including the components necessary for placement of the canisters in and removal of the canisters therefrom.

FIG. 11 illustrates the components necessary for inserting and removing the canisters 38 containing nuclear waste into the laterals. A detachable and retrievable connector 70 is connected to the canisters 38 and a tubular string 72 is connected to the connector 70. The tubular string 72 is used to insert the canister 38 from the surface into the horizontally extending lateral. Once deployed within the lateral, the detachable and retrievable connector 70 is detached from the canister and via the tubular string 72 is removed from the network of laterals in which the canister 38 is deposited and the vertical wellbore 14. The tubular string 72 and detachable and retrievable connector 70 may then be used to place additional canisters 38 within the laterals until either the laterals are filled or all the canisters are stored. The connector 70 may be reconnected to the canister 38 when it is desired to remove the canister 38 from the lateral in which it is stored. The tubular string 72 will be attached to the connector 70 and used to direct the connector 70 through the network of laterals to the canister 38 desired to be removed. Upon reaching the desired canister 38, the connector 70 is reattached to the canister 38 and the tubular string 72 is removed through the vertical wellbore 14 and network of laterals carrying the connector 70 and canister 38 with it.

In operation, an isolated area is selected for placement of the wellbore 14 and laterals 20, 24 and 26. The area must include a rock formation 18 therebelow and at a depth great enough to prevent any nuclear waste which may leak from reaching the surface. The rock formation 18 must also be a predetermined safe distance from any underground active water sources.

Upon selection of an area a drilling rig 10 such as is used to drill oil wells is used to create a vertical wellbore 14 which extends into the selected rock formation 18. A window 46 is then cut into the vertical wellbore 14 at a depth occupied by the rock formation 18 and at each position from which a primary lateral 20 is desired to extend. A horizontal primary lateral 20 is then drilled into the rock formation 18 extending from each window 46 to form each primary lateral 20. The primary laterals 20 may be at differing depths below the surface from one another as long as they extend more or less horizontally, i.e. perpendicular to the vertical wellbore 14, and have dimensions, i.e. sides, defined by the rock formations 18.

Windows 46 are then cut into each primary lateral 20 at each position from which a secondary lateral 24 is desired to extend. The secondary laterals 24 are each then drilled to extend from their respective window 46 and each extend horizontally through the rock formation 18 in the same plane as the primary lateral 20 from which they depend.

Windows 46 are then cut into each secondary lateral 20 at each position from which a tertiary lateral 24 is desired to extend. The tertiary laterals 24 are each then drilled to extend from their respective window 46 and each extend horizontally through the rock formation 18 in the same plane as the primary and secondary laterals 20, 24 from which they depend.

Each primary lateral 20 is cemented in place by circulating the cement to form the cement layer 30 in the annular space between the steel casing 32 and the wall of the wellbore 14. In a similar cementing operation a cement layer is Placed in the secondary and tertiary laterals 24 and 26. A second outer layer 32 of steel is then sealed within the laterals to the first outer layer 30. A first inner layer 34 of cement is then positioned within and sealed to the second outer layer 32 of steel to sandwich the second outer layer 32 between two layers of cement 30, 34. Within the first inner layer 34, a second inner layer 36 made of lead is sealed. Thus, the first inner layer 36 is sealed between a layer of steel 32 and a layer of lead 36. Each of these layers 30, 32, 34 and 36 not only cover the entire inner surface area of the primary, secondary and tertiary laterals 20, 24 and 26 but extend all the way through the vertical wellbore 14 to the surface 12 of the selected area. In order to provide added protection from radiation which may leak within the laterals, the second inner layer 36 of lead may be replaced by alternate constructions.

One such alternate construction is a three tiered structure. In this alternate construction, an outer steel casing 54 is sealed to the first inner layer 34 and an inner lead lining 52 is positioned within the outer steel casing 54. A plurality of liner supports 56 are placed within the inner lead lining 52 and acts to separate the inner lead lining 52 from the outer steel casing 54. The hanging liner shield formed from the inserted layers 52 and 54 and liner supports 56 acts as a radiation shield. The inner lead lining 52 extends only to the entry point of the lateral in which it is positioned, i.e. the position at which the window 46 is cut, while the outer steel casing 54 extends all the way to the top of the vertical wellbore 14.

A second alternate construction for the second inner layer 36 is also formed of a three tiered structure. In this construction, a first layer of steel 60 is positioned within the first inner layer of cement 34. A layer of lead 58 is then positioned within the first inner layer of steel 60 and a second layer of steel 62 is positioned within the layer of lead 58 acting to sandwich the layer of lead 58 between the first and second layers of steel 60, 62. As in the first alternate construction, the layer of lead 58 only extends to the entry point of the lateral. The first and second layers of steel 60, 62 are positioned to cover the entire surface of the lateral in which they are placed and extend through each lateral from which it depends and the vertical wellbore 14. A third layer of steel 64 is positioned between the first and second layers of steel 60, 62 and extends between the sandwiching layers of steel 60, 62 from the entry point of the lateral to the top of the vertical wellbore 14. Portions of the third steel layer 64 may be replaced by a layer of lead 58 within the depending laterals which will house canisters 38 containing nuclear waste. These additional layers 58, 60, 62 and 64 provide added protection from radiation which may leak from the canisters, preventing the radiation from leaving the lateral and entering the host rock formation 18.

A third alternate construction for the second inner casing 36 includes a lead shield casing 66 surrounded by a steel casing 68. The steel casing is positioned within the first inner layer 34 of cement and the lead casing 66 is positioned within and bonded to the steel casing 68. The lead casing 66 extends to the entry point of the lateral. The steel casing 68 extends through the lateral, all laterals on which it depends and extends through the vertical wellbore 14 to the surface 12 of the selected area. This construction, also provides additional protection for the host rock formation 18 from radiation leakage.

A end plug may then be inserted into each lateral in which it is desired to store canisters 38 containing nuclear waste. The laterals are now prepared for storing the canisters containing nuclear waste. A plurality of centralizers 40 may be connected to the canisters 38 to hold the canisters 38 stationary within the lateral in which they are stored. A connector 70 is attached to a first canister 38 and a tubular string 72 is attached to the connector 70. The canister 38 is then directed through the vertical wellbore 14 and through the network of laterals until it reaches its final destination for storage. The connector 70 is then separated from the canister 38 and is removed from the network through the laterals and the vertical wellbore 14 and up to the surface 12 of the selected area by reeling up the tubular string 72. The connector 70 and tubular string 72 are then used to position another canister 38 within the network of laterals. This process is repeated until the network is full or all the canisters 38 are positioned within the network. Front plugs 49 may then be positioned at the entry point of each lateral, i.e. at the point at which the windows 46 are cut, to seal each lateral and prevent any solid, liquid or gaseous material from escaping from the sealed lateral. Alternatively, the network can be filled with cement to seal the canisters in place within their respective lateral and also act to prevent any nuclear waste which may leak from reaching either the rock formation 18 housing the laterals or the surface of the selected area.

From the above description, it is evident that the present invention provides a method of disposing of nuclear waste in underground rock formations and provides prolonged safety from the nuclear waste and added protection to human health and the environment. This method also provides protection in case of rupturing or leaking of the canister in which the waste is stored and safe storage of the waste for at least 10,000 years. It also provides storage of nuclear waste which is impervious to surface effects such as flooding, glaciation or seismic interference. The laterals in which the waste is stored include an inner lining made from layers of cement, steel and lead and possibly also include front and end plugs to provide the above benefits.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed as new and desired to be protected by Letters Patent is set forth in the appended claims:

1. A method of disposing of nuclear waste in underground rock formations, comprising the steps of:

a) electing an area of land having a rock formation positioned therebelow of a depth able to prevent radioactive material placed therein from reaching a surface of the area of land and of a predetermined distance from active water sources;

b) drilling a vertical wellbore from the surface of the area of land to extend into the underground rock formation;

c) drilling a first primary horizontal lateral extending from the vertical wellbore whereby the primary horizontal lateral is defined by the underground rock formation;

d) forming a first layer of cement within the primary horizontal lateral by circulating cement between a steel casing and the wall of the wellbore in the primary horizontal lateral;

e) securing the steel casing within the first layer of cement by the cementing process indicated in step (d);

f) encapsulating nuclear waste to be stored in a canister for storage in the primary horizontal lateral;

g) placing the encapsulated nuclear waste in the primary horizontal lateral.

2. The method of disposing nuclear waste in underground rock formations, comprising the steps of:

a) drilling a plurality of primary horizontal laterals into the rock formation from the vertical wellbore whereby each of the plurality of primary horizontal laterals are defined by the underground rock formation;

b) forming a first layer of cement within the plurality of primary horizontal lateral by circulating cement between a steel casing and the wall of the wellbore in the plurality of primary horizontal laterals;

c) securing the steel casing within the first layer of cement by the cementing process indicated in step (b);

d) encapsulating nuclear waste to be stored in a plurality of canisters, each of said plurality of canisters to be stored in one of the plurality of primary horizontal laterals; and e) placing each of the plurality of canisters in a respective one of the plurality of primary horizontal laterals.

3. The method of disposing nuclear waste in underground rock formations as recited in claim 1, further comprising the steps of:

a) drilling at least one secondary horizontal lateral into the rock formation from the primary horizontal lateral, the at least one secondary horizontal lateral extending in a horizontal plane with the primary horizontal laterals and being defined by the underground rock formation;

b) forming a first layer of cement within the at least one secondary horizontal lateral by circulating cement between a steel casing and the wall of the wellbore in the at least one secondary horizontal lateral;

c) securing the steel casing within the first layer of cement by the cementing process indicated in step (b);

d) encapsulating nuclear waste to be stored in a plurality of canisters, each of said plurality of canisters to be stored in one of the primary and at least one secondary horizontal laterals; and e) placing each of the plurality of canisters in a respective one of the primary and at least one secondary horizontal laterals.

4. The method of disposing nuclear waste in underground rock formations as recited in claim 2, further comprising the steps of:

a) drilling a plurality of secondary horizontal laterals into the rock formation from each of the plurality of primary horizontal laterals, each of the plurality of secondary horizontal laterals extending in a horizontal plane with the respective one of the plurality of primary horizontal laterals from which it extends and being defined by the underground rock formation;

b) forming a first layer of cement within the plurality of secondary horizontal laterals by circulating cement between a steel casing and the wall of the wellbore in the plurality of secondary horizontal laterals;

c) securing the steel casing within the first layer of cement by the cementing process indicated in step (b);

d) encapsulating nuclear waste to be stored in a plurality of canisters, each of said plurality of canisters to be stored in one of the plurality of primary and secondary horizontal laterals; and e) placing each of the plurality of canisters in a respective one of the plurality of primary and secondary horizontal laterals.

5. The method of disposing nuclear waste in underground rock formations as recited in claim 3, further comprising the steps of:

a) drilling at least one tertiary horizontal lateral into the rock formation from the at least one secondary horizontal lateral, the at least one tertiary horizontal lateral extending in a horizontal plane with the primary and at least one secondary horizontal laterals and being defined by the underground rock formation;

b) forming a first layer of cement within the at least one tertiary horizontal lateral by circulating cement between a steel casing and the wall of the wellbore in the at least one tertiary horizontal lateral;

c) securing the steel casing within the first layer of cement by the cementing process indicated in step (b);

d) encapsulating nuclear waste to be stored in a plurality of canisters, each of said plurality of canisters to be stored in one of the primary, at least one secondary and at least one tertiary horizontal laterals;

e) placing each of the plurality of canisters in a respective one of the primary, at least one secondary and at least one tertiary horizontal laterals.

6. The method of disposing nuclear waste in underground rock formations as recited in claim 4, further comprising the steps of:

a) drilling a plurality of tertiary horizontal laterals into the rock formation from each of the plurality of secondary horizontal laterals, the plurality of tertiary horizontal laterals extending in a horizontal plane with the plurality of primary and secondary horizontal laterals from which they depend and being defined by the underground rock formation;

b) forming a first layer of cement within the plurality of tertiary horizontal laterals by circulating cement between a steel casing and the wall of the wellbore in the plurality of tertiary horizontal laterals;

c) securing the steel casing within the first layer of cement by the cementing process indicated in step (b);

d) encapsulating nuclear waste to be stored in a plurality of canisters, each of said plurality of canisters to be stored in one of the plurality of primary, secondary and tertiary horizontal laterals; and e) placing each of the plurality of canisters in a respective one of the primary, secondary and tertiary horizontal laterals.

7. The method of disposing nuclear waste in underground rock formations as recited in claim 5, further comprising the steps of:

a) placing a third layer of concrete within the second layer of steel in each of the primary, at least one secondary and at least one tertiary laterals; and b) sealing a fourth layer of lead within the third layer of concrete in each of the primary, at least one secondary and at least one tertiary laterals.

8. The method of disposing nuclear waste in underground rock formations as recited in claim 6, further comprising the steps of:

a) placing a third layer of concrete within the second layer of steel within in each of the plurality of primary, secondary and tertiary laterals; and b) sealing a fourth layer of lead within the third layer of concrete within in each of the plurality of primary, secondary and tertiary laterals.

9. The method of disposing nuclear waste in underground rock formations as recited in claim 7, further comprising the steps of:

a) placing a front plug within each of the primary, at least one secondary and at least one tertiary laterals at a respective terminating end thereof prior to said step of placing the encapsulated nuclear waste in the primary horizontal lateral; and b) placing an end plug within each of the primary, at least one secondary and at least one tertiary laterals at a respective front end opposite the terminating end thereof after said step of placing the encapsulated nuclear waste in the primary horizontal lateral.

10. The method of disposing nuclear waste in underground rock formations as recited in claim 8, further comprising the steps of:

a) placing a front plug within each of the plurality of primary, secondary and tertiary laterals at a respective terminating end thereof prior to said step of placing the encapsulated nuclear waste in each of the plurality of primary, secondary and tertiary laterals; and b) placing an end plug within each of the plurality of primary, secondary and tertiary laterals at a respective front end thereof opposite the terminating end after said step of placing the encapsulated nuclear waste in each of the plurality of primary, secondary and tertiary laterals.

11. The method of disposing nuclear waste in underground rock formations as recited in claim 5, further comprising the steps of:

a) placing a third layer of concrete within the second layer of steel in each of the primary, at least one secondary and at least one tertiary laterals;

b) sealing a fourth layer of steel within the third layer of concrete in each of the primary, at least one secondary and at least one tertiary laterals;

c) positioning a fifth layer of lead within the fourth layer of steel in each of the primary, at least one secondary and at least one tertiary laterals; and d) placing a plurality of separators between the fourth layer of steel and the fifth layer of lead to separate the fourth and fifth layers in each of the primary, at least one secondary and at least one tertiary laterals.

12. The method of disposing nuclear waste in underground rock formations as recited in claim 6, further comprising the steps of:

a) placing a third layer of concrete within the second layer of steel in each of the plurality of primary, secondary and tertiary laterals;

b) sealing a fourth layer of steel within the third layer of concrete in each of the plurality of primary, secondary and tertiary laterals;

c) positioning a fifth layer of lead within the fourth layer of steel in each of the plurality of primary, secondary and tertiary laterals; and d) placing a plurality of separators between the fourth layer of steel and the fifth layer of lead in each of the plurality of primary, secondary and tertiary laterals to separate the fourth and fifth layers in each of the plurality of primary, secondary and tertiary laterals.

13. The method of disposing nuclear waste in underground rock formations as recited in claim 5, further comprising the steps of:

a) placing a third layer of concrete within the second layer of steel in each of the primary, at least one secondary and at least one tertiary laterals;

b) sealing a fourth layer of steel within the third layer of concrete in each of the primary, at least one secondary and at least one tertiary laterals;

c) positioning a fifth layer of lead within the fourth layer of steel in each of the primary, at least one secondary and at least one tertiary laterals; and d) placing a sixth layer of steel within the fifth layer of lead.

14. The method of disposing nuclear waste in underground rock formations as recited in claim 6, further comprising the steps of:

a) placing a third layer of concrete within the second layer of steel in each of the plurality of primary, secondary and tertiary laterals;

b) sealing a fourth layer of steel within the third layer of concrete in each of the plurality of primary, secondary and tertiary laterals;

c) positioning a fifth layer of lead within the fourth layer of steel in each of the plurality of primary, secondary and tertiary laterals; and d) placing a sixth layer of steel within the fifth layer of lead in each of the plurality of primary, secondary and tertiary laterals.

15. The method of disposing nuclear waste in underground rock formations as recited in claim 5, further comprising the steps of:

a) placing a third layer of concrete within the second layer of steel in each of the primary, at least one secondary and at least one tertiary laterals;

b) sealing a fourth layer of steel within the third layer of concrete in each of the primary, at least one secondary and at least one tertiary laterals; and c) positioning a fifth layer of lead within the fourth layer of steel in each of the primary, at least one secondary and at least one tertiary laterals.

16. The method of disposing nuclear waste in underground rock formations as recited in claim 6, further comprising the steps of:

a) placing a third layer of concrete within the second layer of steel in each of the plurality of primary, secondary and tertiary laterals;

b) sealing a fourth layer of steel within the third layer of concrete in each of the plurality of primary, secondary and tertiary laterals; and c) positioning a fifth layer of lead within the fourth layer of steel in each of the plurality of primary, secondary and tertiary laterals.

17. The method of disposing nuclear waste in underground rock formations as recited in claim 5, wherein said step of placing each of the plurality of canisters comprises the steps of:

a) attaching a tubular string to a connection device;

b) attaching the connection device to one of the plurality of canisters;

c) inserting the one of the plurality of canisters and connection device into the vertical wellbore;

d) directing the one of the plurality of canisters into one of the primary, at least one secondary and at least one tertiary laterals;

e) disconnecting the connection device from the one of the plurality of canisters;

f) removing the tubular string and connection device from the vertical wellbore;

g) connecting the connection device to another of the plurality of canisters; and h) repeating steps a)–g) until each canister is positioned in a respective one of the primary, at least one secondary and at least one tertiary laterals.

18. The method of disposing nuclear waste in underground rock formations as recited in claim 6, wherein said step of placing each of the plurality of canisters comprises the steps of:

a) attaching a tubular string to a connection device;

b) attaching the connection device to one of the plurality of canisters;

c) inserting the one of the plurality of canisters and connection device into the vertical wellbore;

d) directing the one of the plurality of canisters into one of the plurality of primary, secondary and tertiary laterals;

e) disconnecting the connection device from the one of the plurality of canisters;

f) removing the tubular string and connection device from the vertical wellbore;

g) connecting the connection device to another of the plurality of canisters; and h) repeating steps a)–g) until each canister is positioned in a respective one of the plurality of primary, secondary and tertiary laterals.

19. The method of disposing nuclear waste in underground rock formations as recited in claim 5, further comprising the step of filling the primary, at least one secondary and at least one tertiary horizontal laterals with cement to seal the encapsulated nuclear waste therein.

20. The method of disposing nuclear waste in underground rock formations as recited in claim 6, further comprising the step of filling the plurality of primary, secondary and tertiary horizontal laterals with cement to seal the encapsulated nuclear waste therein.

* * * * *